US006053851A

United States Patent [19]

Tu

[11] Patent Number: 6,053,851

[45] Date of Patent: Apr. 25, 2000

[54] BODY EXERCISER

[76] Inventor: Ming-Tsang Tu, 7 Fl., No. 96, Jen-Ai 1st St., Kaohsiung, Taiwan

[21] Appl. No.: 09/266,180

[22] Filed: Mar. 10, 1999

[51] Int. Cl.[7] ..... A63B 21/02

[52] U.S. Cl. ..... 482/122; 482/126; 482/121

[58] Field of Search ..... 482/44, 45, 49, 482/121, 122, 140, 126

[56] References Cited

U.S. PATENT DOCUMENTS

| | | | |
|---|---|---|---|
| D. 208,787 | 10/1967 | Prescott | 482/122 |
| 4,022,463 | 5/1977 | Scott, Jr. | 482/122 |
| 5,160,304 | 11/1992 | Van Der Hoeven | 482/128 |
| 5,360,385 | 11/1994 | Wang | 482/49 |
| 5,599,256 | 2/1997 | Hughes, Jr. | 482/49 |
| 5,720,701 | 2/1998 | Truini | 482/126 |
| 5,749,815 | 5/1998 | Lipps | 482/122 |
| 5,779,605 | 7/1998 | Tu | 482/122 |
| 5,833,580 | 11/1998 | Chiu | 482/49 |
| 5,891,005 | 4/1999 | Drukarov | 482/140 |
| 5,964,685 | 10/1999 | Boland | 482/122 |

*Primary Examiner*—Jerome Donnelly
*Attorney, Agent, or Firm*—William E. Pelton, Esq.

[57] ABSTRACT

The invention provides a simple, small, and easy-to-assemble body exerciser which has a compression arm, a stationary arm pivotally connected to the compression arm, and a spring provided between the compression arm and the stationary arm. The body exerciser can be used to exercise a user's abdomen and arm muscles and can be folded to reduce the storage space.

3 Claims, 10 Drawing Sheets

BODY EXERCISER

FIELD OF THE INVENTION

The invention relates to an improved body exerciser, especially to a simple, compact and foldable body exerciser.

BACKGROUND OF THE INVENTION

There are various kinds of body exercisers, which include joggers, twisters, arm exercisers and so on. However, such special body exercisers are only used for exercising certain parts of a body, and if a user wants to exercise other parts of his/her body, a universal body exerciser is needed.

Unfortunately, most present universal body exercisers are too large and expensive for family use.

As shown in FIG. 10, a U.S. Pat. No. 5,779,605 filed on Sep. 3, 1997, issued to Tu concerns a body building machine. This device includes a first plate (50), a covering portion (60), a fixing plate (70), a pivotal pole (74) and a bar (75). The first plate (50) has a butt (51) which forms a container (52). In assembling, the fixing plate (70) and the covering portion (60) are inserted into the container (52) from under respectively at each side of the first plate (50) and then pivotally fixed with respect to the first plate (50) by the pivotal pole (74). A spring means (80) is provided for connection the upper ends of the covered portions (60) and the fixing plate (70). The other ends of them are respectively provided with a cushion (601) and fixed with the first plate (50) by a bar (75).The conventional exerciser shown in FIG. 10 has a frame (50), a compression arm (60) and a stationary arm (70) securely received in the frame (50) and pivotally connected with the compression arm (60) by a hinge pin (74). The frame (50) has a hollow head (51) formed at one end thereof. A first end of the stationary arm (70) is connected to the other end of the frame (50) by a pin (75), and the second end of the stationary arm (70) is inserted through the hollow head (51) and pivotally connected with the compression arm (60). The second end of the stationary arm (70) is connected the corresponding end of the compression arm (60) by a plurality of springs (81) and a rubber band (82).

However, the plurality of springs (81) connected between the ends of the compression arm (60) and the stationary arm (70) must be manually mounted one by one, which increases the assembly cost cost. Furthermore, after the exerciser is assembled, the size thereof is large and can not be folded, which is not convenient for storage in a compact space.

SUMMARY OF THE INVENTION

The main objective of the invention is to provide a simple, compact and foldable body exerciser.

DETAILED DESCRIPTION OF THE PREFERRED EMBODIMENT

Figure 1:
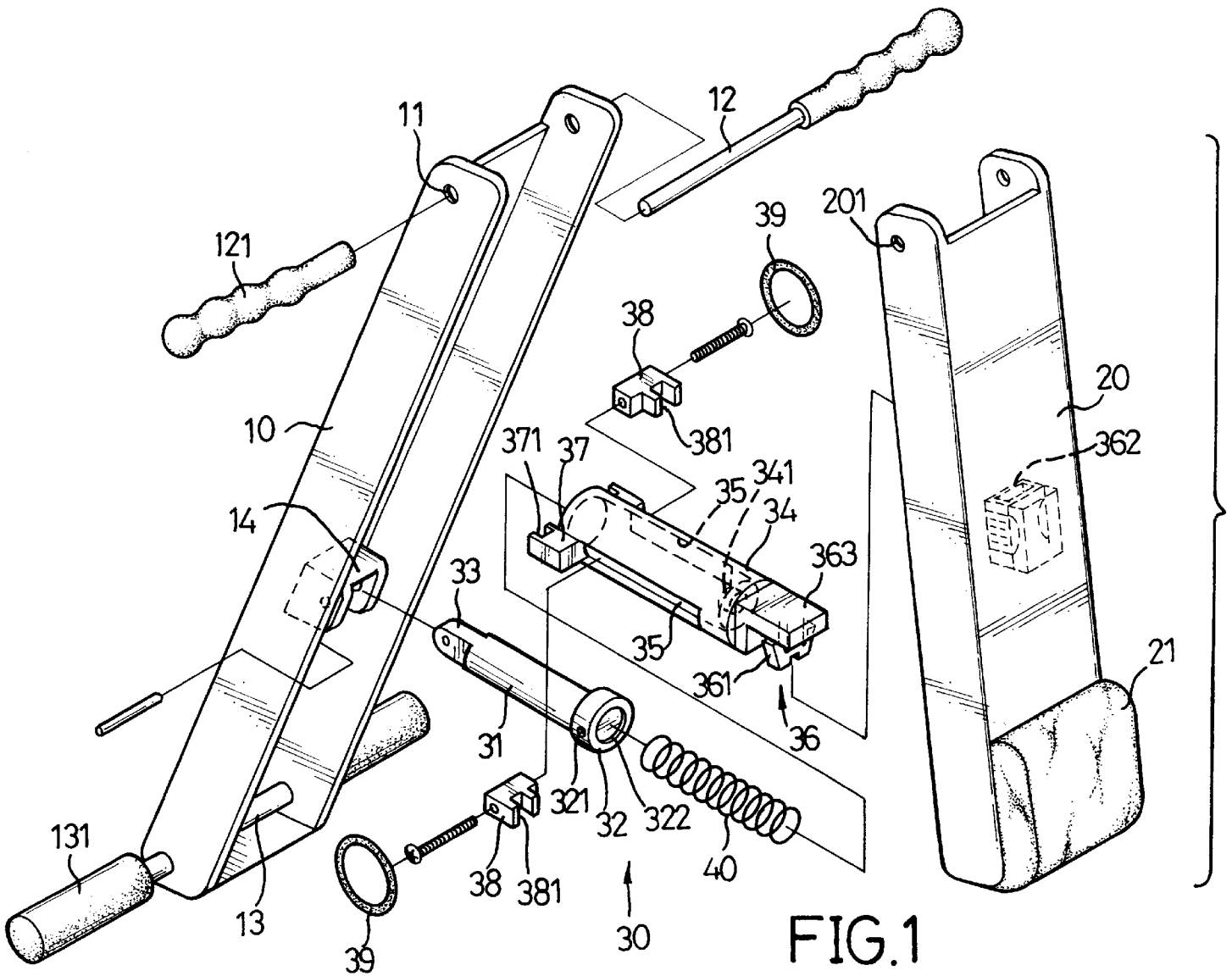
FIG. 1 is a perspective exploded view of the invention.
Figure 2:
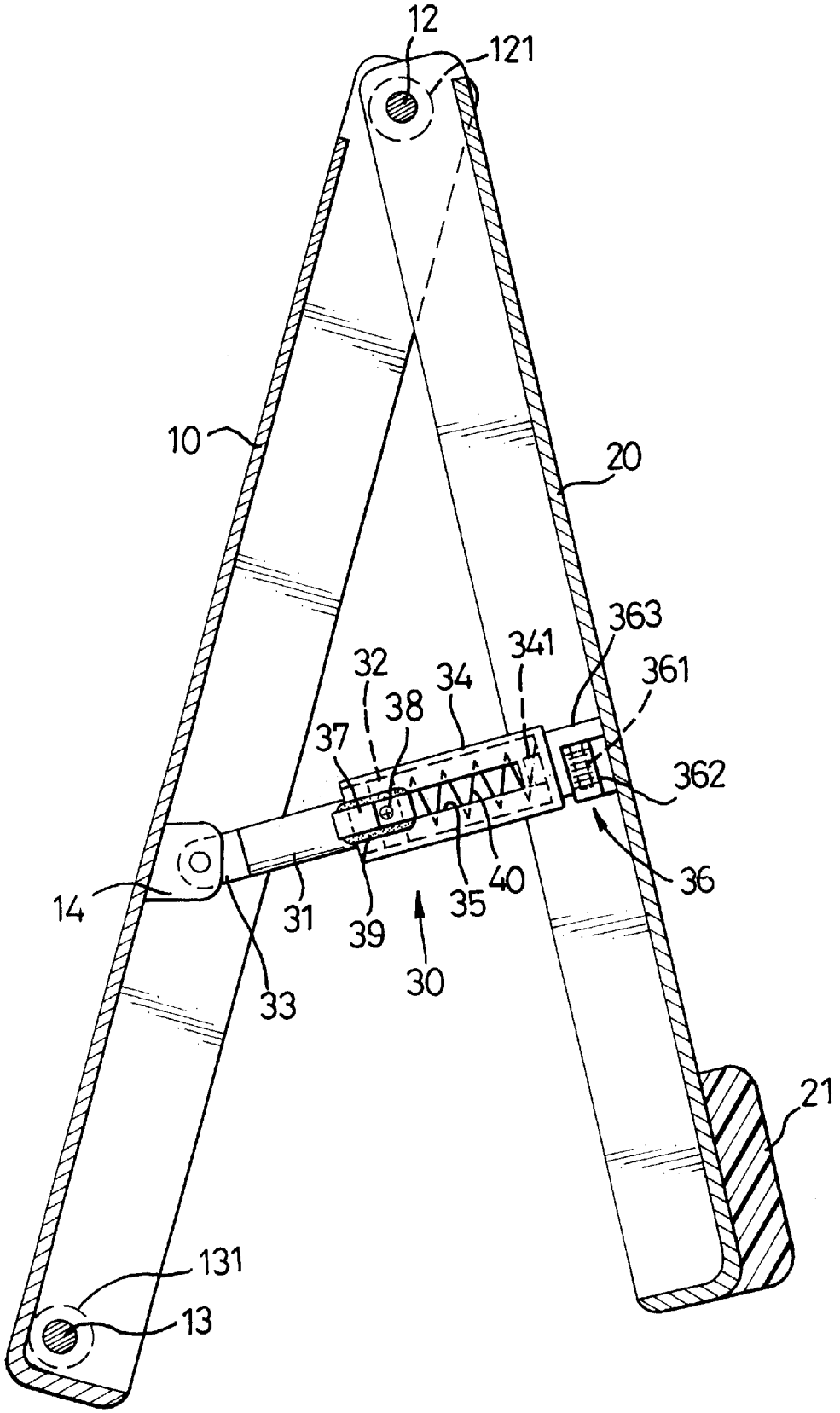
FIG. 2 is a side plan view in partial section of the invention.

As shown in FIGS. 1 and 2, a body exerciser constructed in accordance of the invention comprises a compression arm (10), a stationary arm (20) pivotally connected at the top end of the compression arm (10) by a hinge pin (12) inserted through holes (11, 201) defined in the compression arm (10) and the stationary arm (20) respectively, and a resistive member (30) provided between the compression arm (10) and the stationary arm (20). A bar (13) covered by protective material (131) is provided at the bottom end of the compression arm (10). The stationary arm (20) has a cushion (21) mounted at the outer side of the bottom end.

The resistive member (30) consists of an outer tube (34), an inner tube (31) slidably received in the outer tuber (34) and a spring (40) compressed between the two. The inner tube (31) has an eye (33) which can be pivotally connected to a socket (14) formed on an inner face of the compression arm (10), and a collar (32) having a diameter greater than that of the inner tube (31) to snugly but slidably fit inside the outer tube. The collar (32) has a pair threaded openings (321) defined on opposite sides of the collar (32) and a recessed inner flange (322) formed on the end face defining the collar (32).

The outer tube (34) is detachably connected to the inner face of the stationary arm (20) by means of a latch device (36) which comprises a tongue (361) formed under an extension (363) formed on the bottom of the outer tube (34), and a tongue seat (362) formed on an inner face of the stationary arm (20). A protrusion (341) is provided on an inner end face of the outer tube (34) for securing one end of the spring (40). A pair of longitudinal slots (35) are defined in on opposite sides of the outer tube (34). Two first blocks (37) are respectively mounted on the end portion of the outer tube (34) and each have a groove (371) defined therein.

During assembly, one end of the spring (40) is first inserted into the outer tube (34) and abutted against the protrusion (341). The other end of the spring (40) is abutted against the inner flange (322) of the inner tube (31), after the collar (32) is inserted into the outer tube (34). A pair of second blocks (38) respectively having a cutout (381) are then fixed to the collar (32) by a pair of screws (not numbered). After the inner tube (31) is inserted into the outer tube (34), each of the second blocks (38) are inserted through the respective slots (35) of the outer tube (34) and then secured to the collar (32) of the inner tube (31) by inserting the screw through the respective second blocks (38) and into the threaded openings (321) in the collar (32). After the inner tube (31) and the outer tube (34) are connected, the connection end (33) of the inner tube (31) is pivotally connected to the socket (14) and the tongue (361) is detachably snapped into the tongue seat (362).

Figure 3:
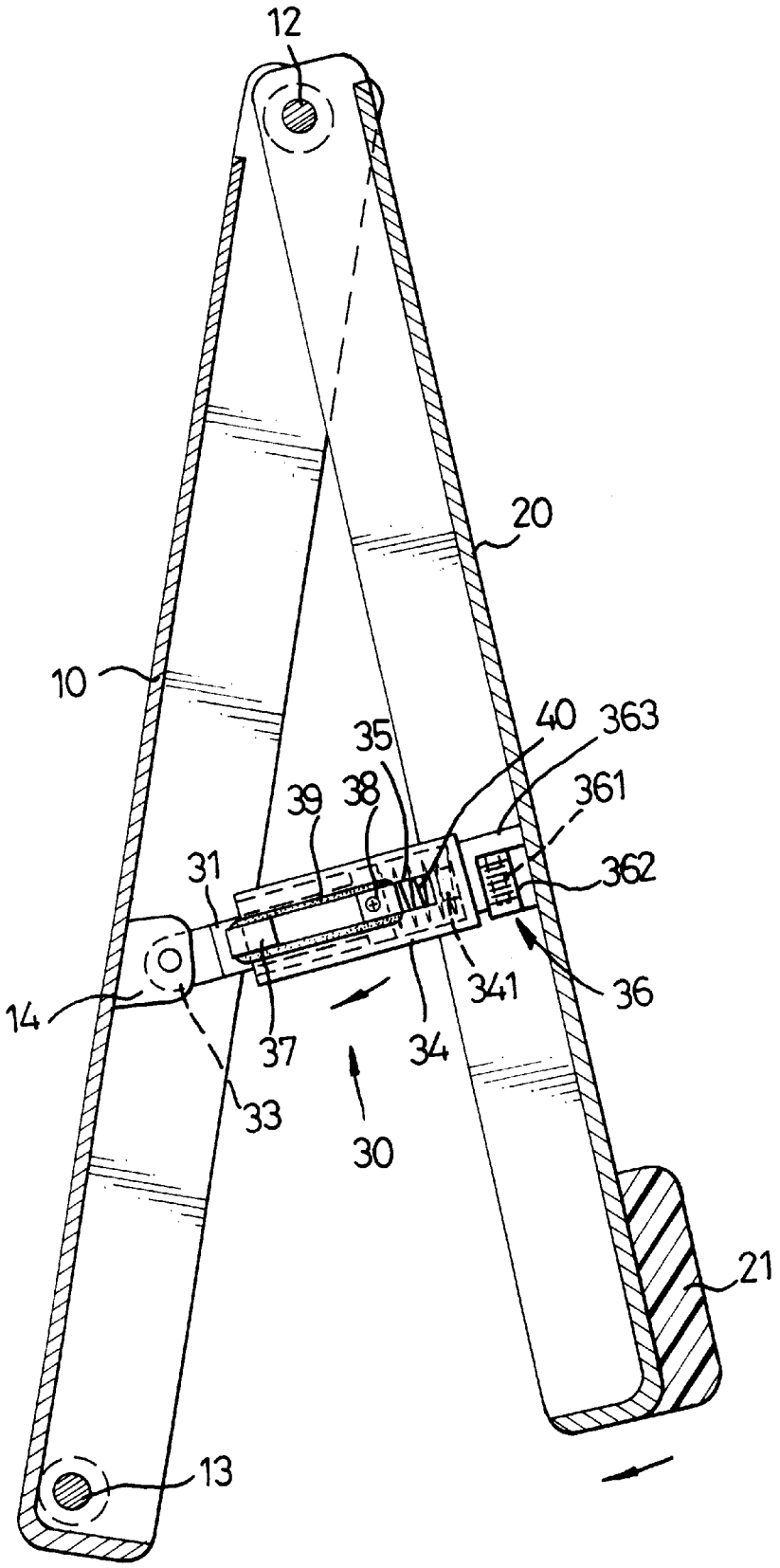
FIG. 3 is a side plan view in partial section showing the operation of the invention.
Figure 4:
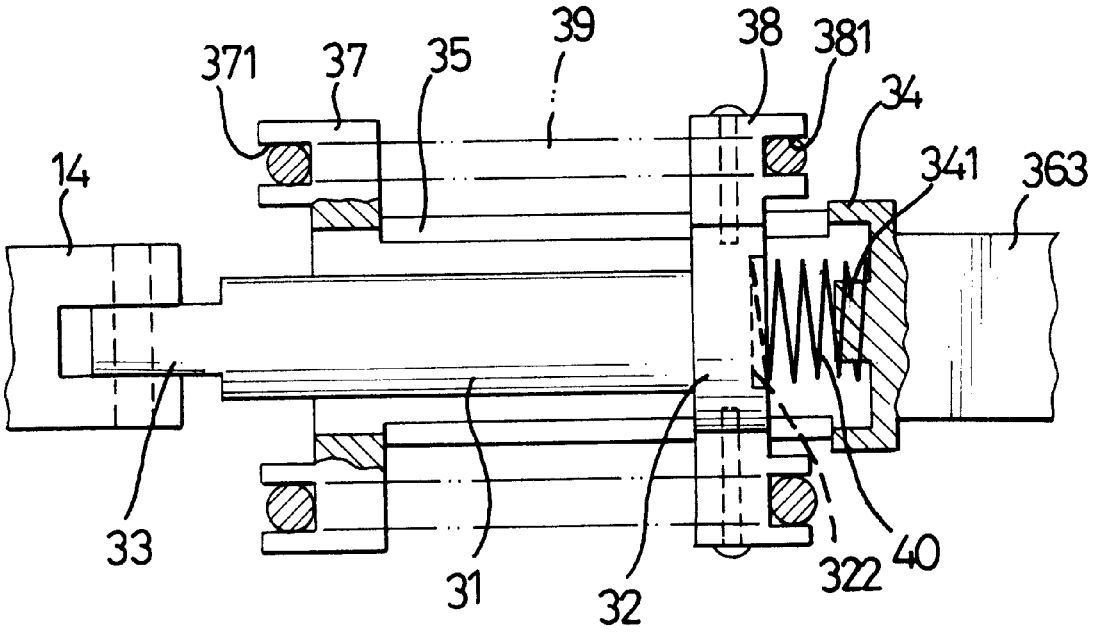
FIG. 4 is an enlarged top plan view in partial section showing the details of the operation of the resistive member as shown in FIG. 3.
Figure 5:
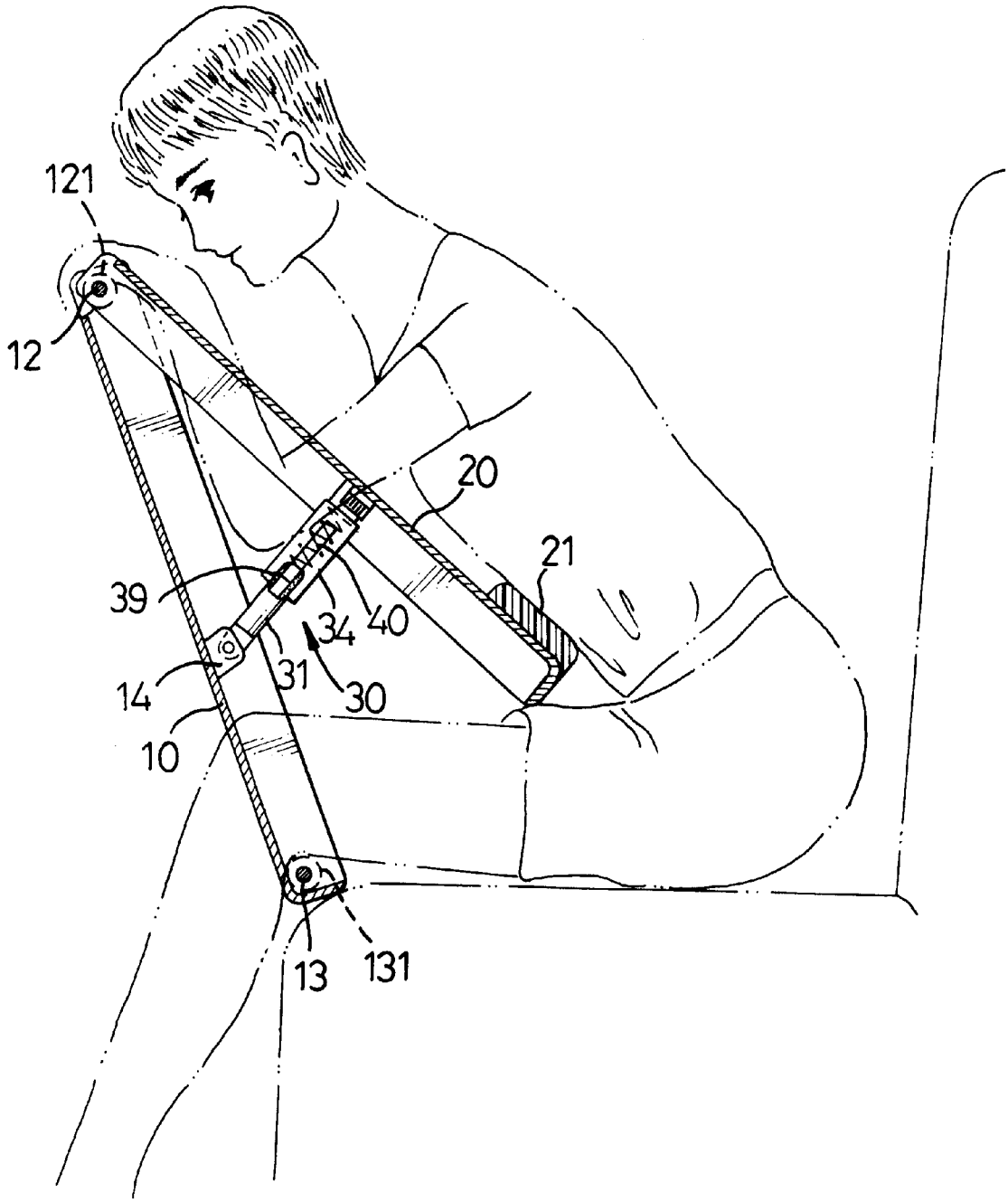
FIG. 5 is a schematic view showing a first application of the invention.
Figure 6:
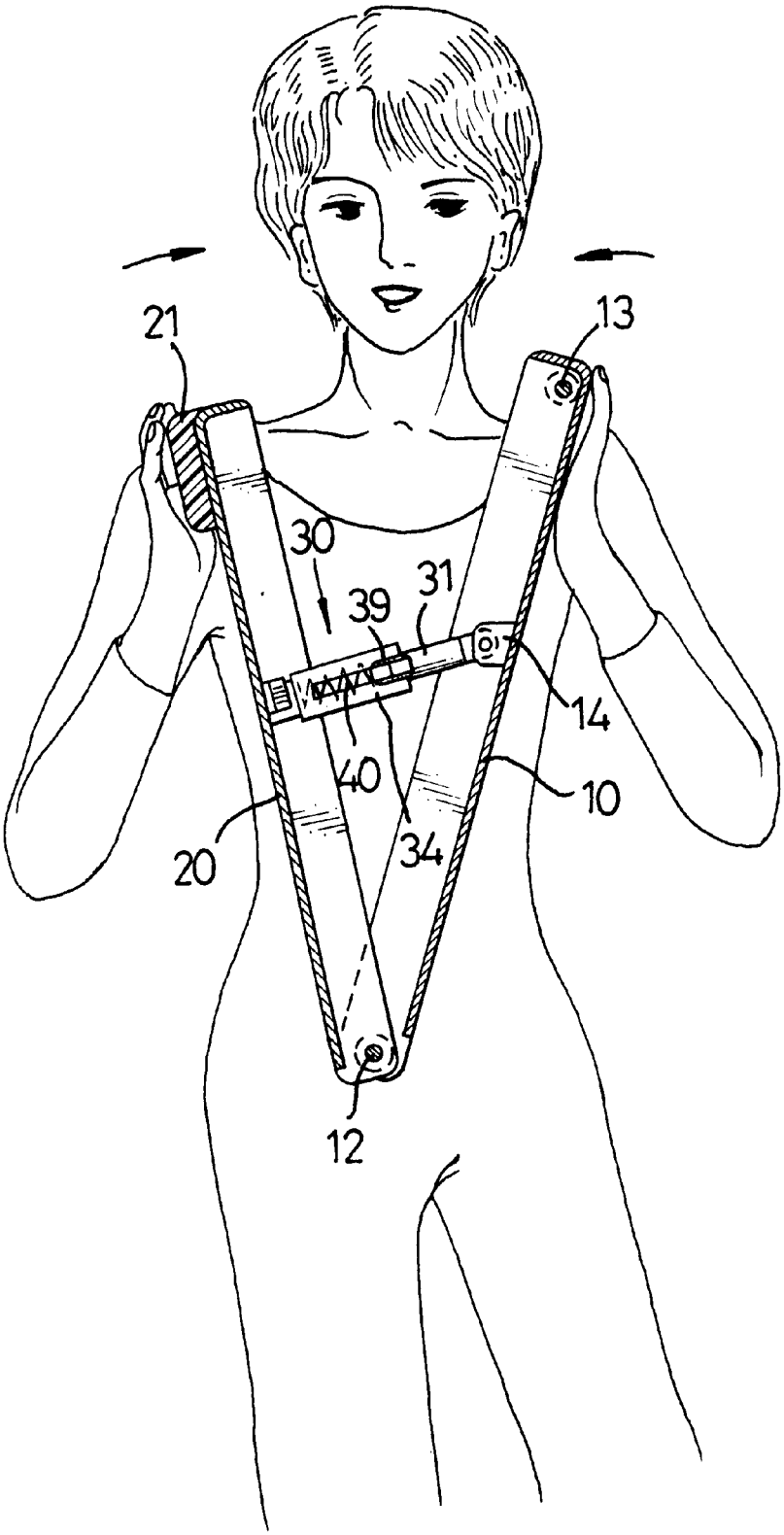
FIG. 6 is a schematic view showing a second application of the invention.
Figure 7:
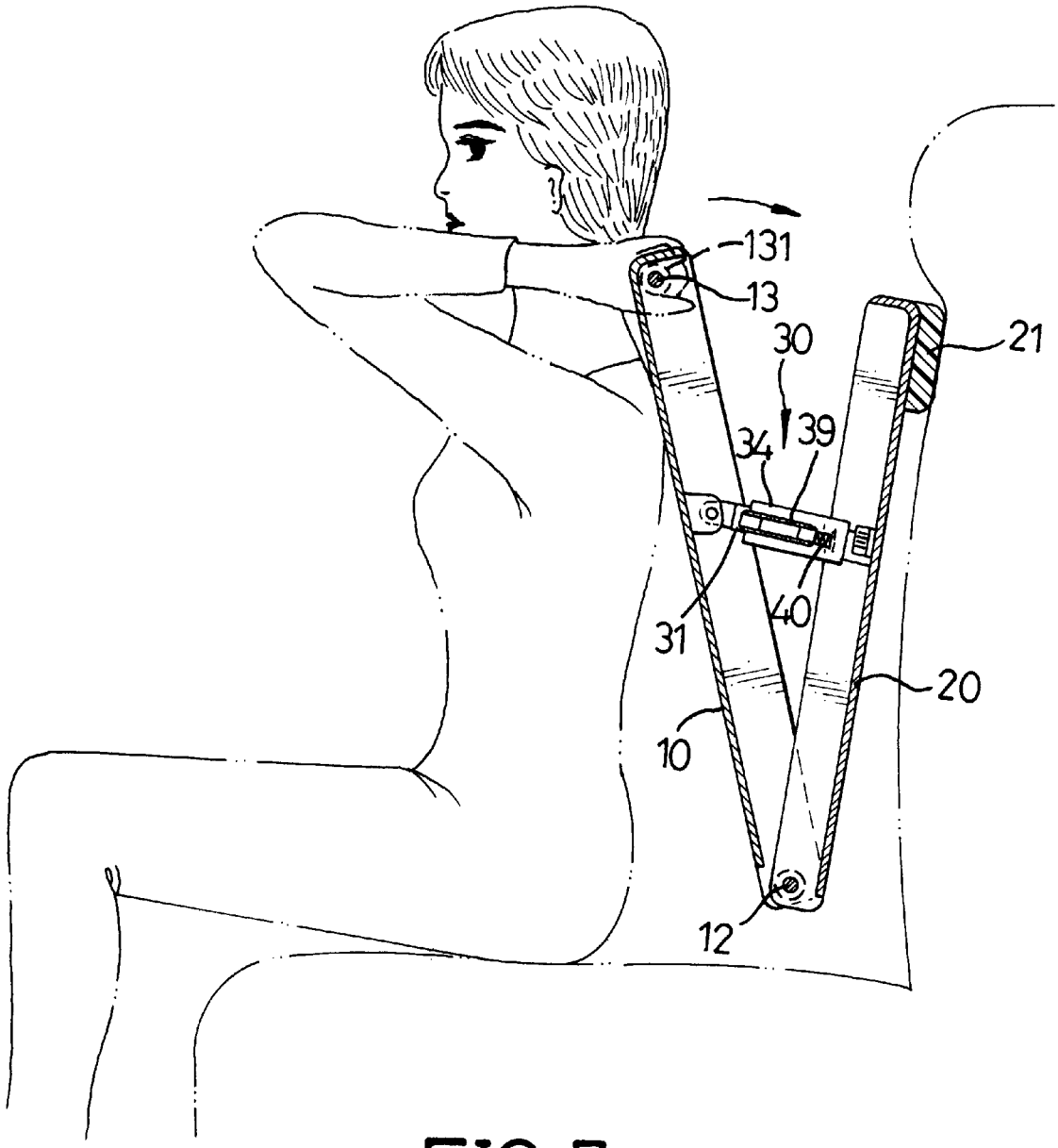
FIG. 7 is a schematic view showing a third application of the invention.
Figure 8:
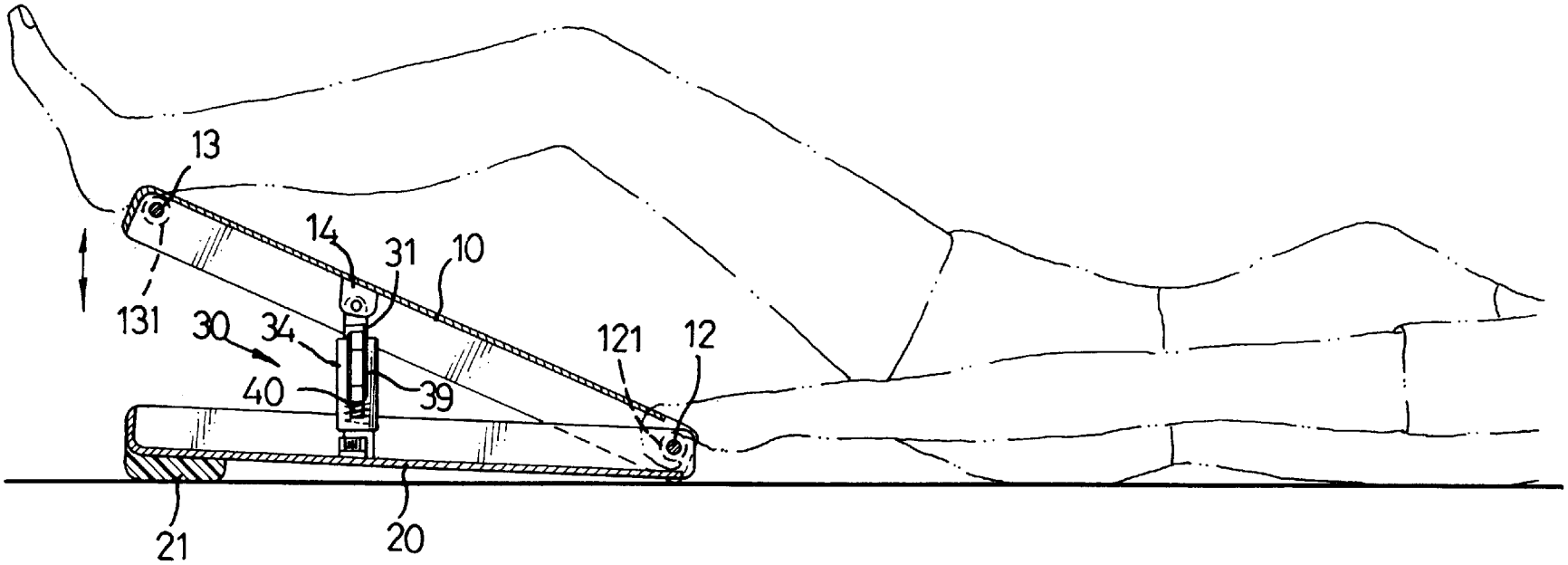
FIG. 8 is a schematic view showing a fourth application of the invention.

Referring to the FIGS. 3 and 4 and again taking FIGS. 1 and 2 for reference, when the pair of second blocks (38) are securely connected with the inner tube (31) and slidably received in the slots (35) of the outer tube (35), a rubber band (39) is able to be positioned in the opposed groove (371) of the first block (37) and the cutout (381) of the second block (38) so as to function as a recoil source when in application.

Referring to FIGS. 5–8, a user is able to use the invention to improve his/her abdomen, chest, back or legs by placing the invention on wherever needs to be improved.

The second usage is that the user can push the compression arm (10) and the stationary arm (20) toward each other. The spring (40) returns the exerciser to its expanded configuration. This can improve the user's arms.

Figure 9:
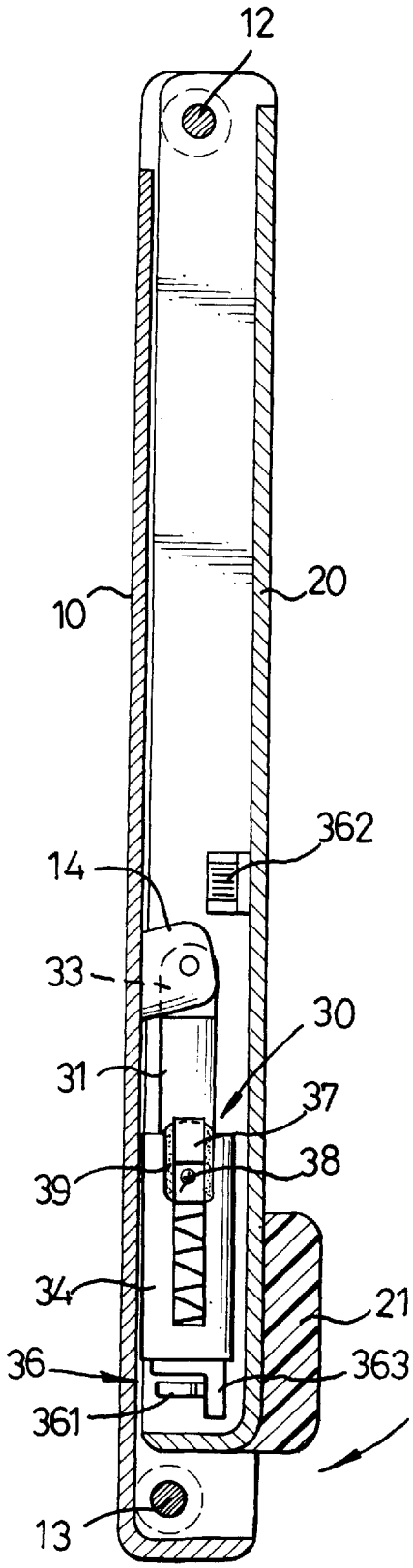
FIG. 9 is a side plan view in partial section showing the folding operation of the invention.
Figure 10:
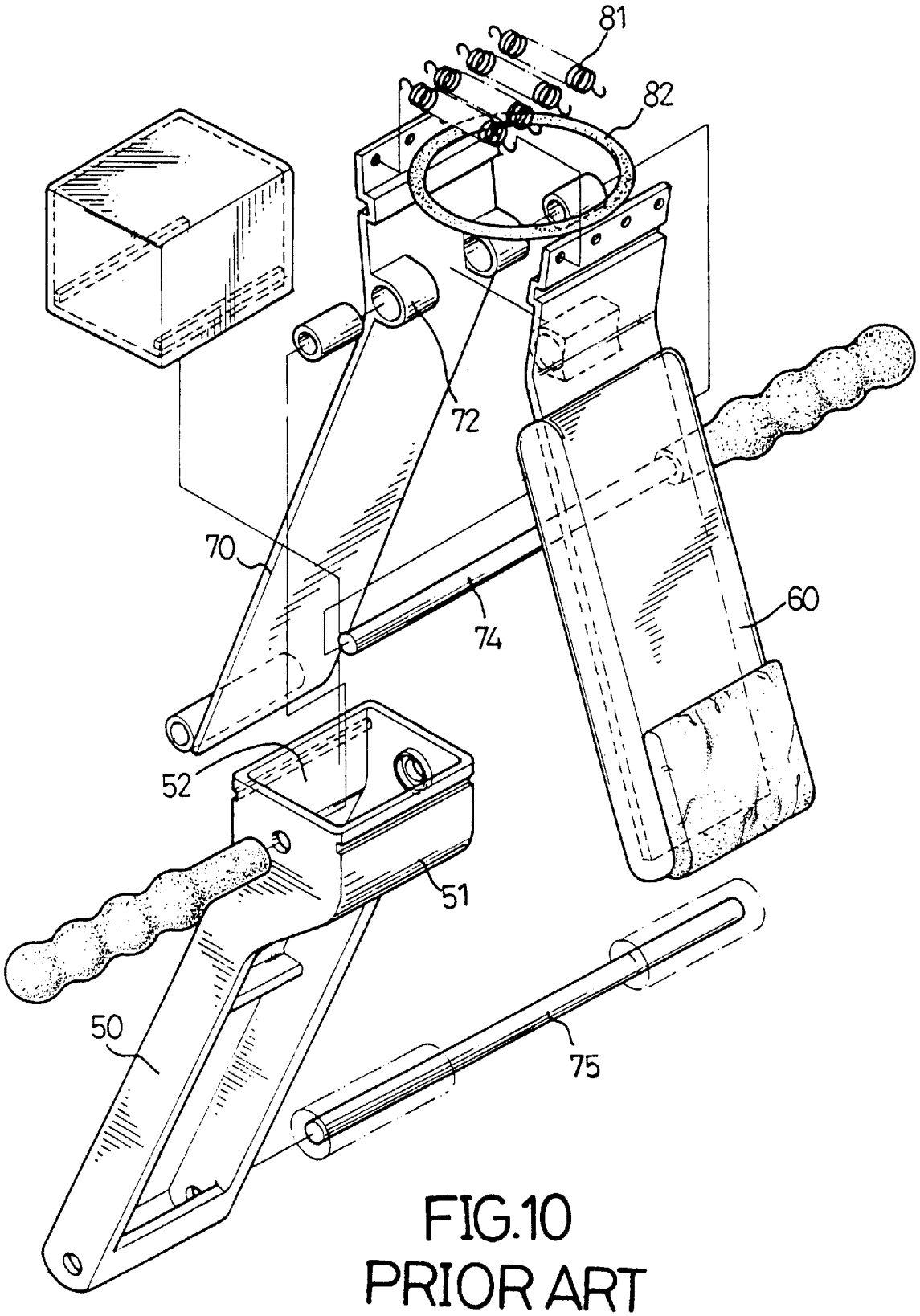
FIG.10 PRIOR ART
FIG. 10 is exploded perspective view of a conventional body exerciser.

Referring to FIG. 9, when the body exerciser of the invention is not in use, the user is able to detach the tongue (361) from the tongue seat (362) to separate the compression arm (10) from the stationary arm (20). After the compression arm (10) and the stationary arm (20) are separated, the body exerciser can be folded to save space. Therefore, it is noted from the description above that the invention has the following advantages:

1. simple structure;
2. easy to assembly;
3. easy to operate;
4. foldable; and
5. reduced fabrication cost.

What is claimed is:

1. An improved body exerciser comprising a compression arm, a stationary arm pivotally connected to the compression arm by a hinge pin, a bar formed on the bottom end of the compression arm, a cushion provided on the bottom portion of the compression arm, a spring provided between the compression arm and the stationary arm, wherein the improvements comprise:

an inner tube one end pivotally connected to the compression arm and the other end has a collar formed therewith and having a diameter greater than the diameter of the inner tube and an inner flange formed on the end face defining the collar;

an outer tube slidably receiving said inner tube therein and having a latch device formed thereunder to detachably connect the outer tube to the stationary arm;

a spring compressibly received in said outer tube and securely abutted to the inner flange of the inner tube; and a pair of rubber bands each provided between said inner and outer tubes.

2. The improved body exerciser as claimed in claim 1, wherein the outer tube has a pair of longitudinal defined slots on opposite sides, a pair of first blocks respectively formed on an end thereof and each having a groove defined therein;

a pair of second blocks each inserted through the respective slots of said outer tube and secured with said collar of said inner tube; and each said second block having a cutout oriented opposite to said groove of said first block; whereby the rubber band is able to be positioned on said groove and said cutout.

3. The improved body exerciser as claimed in claim 1 wherein said latch device comprises a tongue formed under the bottom of the outer tube, and a tongue seat formed on the inner face of said stationary arm.

* * * * *